US010352204B2

(12) United States Patent
Bayrakdar

(10) Patent No.: US 10,352,204 B2
(45) Date of Patent: Jul. 16, 2019

(54) CAMSHAFT ADJUSTER

(71) Applicant: Schaeffler Technologies AG & Co. KG, Herzogenaurach (DE)

(72) Inventor: Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 547 days.

(21) Appl. No.: 14/758,717

(22) PCT Filed: Oct. 8, 2013

(86) PCT No.: PCT/DE2013/200202

§ 371 (c)(1),
(2) Date: Jun. 30, 2015

(87) PCT Pub. No.: WO2014/108116

PCT Pub. Date: Jul. 17, 2014

(65) Prior Publication Data

US 2015/0337693 A1 Nov. 26, 2015

(30) Foreign Application Priority Data

Jan. 14, 2013 (DE) ..... 10 2013 200 402

(51) Int. Cl.
*F01L 1/344* (2006.01)
*F01L 1/047* (2006.01)

(52) U.S. Cl.
CPC ..... *F01L 1/344* (2013.01); *F01L 1/047* (2013.01); *F01L 1/3442* (2013.01)

(58) Field of Classification Search
CPC ..... F01L 1/344; F01L 1/3442; F01L 1/1047
USPC ..... 123/90.17
See application file for complete search history.

(56) References Cited

U.S. PATENT DOCUMENTS 6,845,740 B2 1/2005 Kohrs
8,424,500 B2 * 4/2013 David ..... F01L 1/344 123/90.15
8,826,873 B2 * 9/2014 Landersdorfer ..... F01L 1/053 123/90.15
2005/0045128 A1 3/2005 White et al.
(Continued)

FOREIGN PATENT DOCUMENTS

CN 101438033 A 5/2009
DE 199 21 890 8/2000
(Continued)

*Primary Examiner* — Phutthiwat Wongwian
*Assistant Examiner* — Loren C Edwards
(74) *Attorney, Agent, or Firm* — Davidson, Davidson & Kappel, LLC

(57) ABSTRACT

A camshaft adjusting device, including a vane cell adjuster is provided. The vane cell adjuster includes a stator-that can be connected to a crankshaft of an internal combustion engine, a rotor, which is rotatably supported in the stator and can be connected to a camshaft and has a plurality of working chambers, which are provided between the stator and the rotor and to which a pressure medium can be applied, and a central screw for clamping the rotor to the camshaft by clamping surfaces of the rotor and of the camshaft facing each other. At least one of the clamping surfaces of the rotor and/or of the camshaft is profiled at least in some sections in order to create a form-closed connection.

12 Claims, 7 Drawing Sheets

(56) References Cited

U.S. PATENT DOCUMENTS

| | | | |
|---|---|---|---|
| 2009/0114502 | A1 | 5/2009 | Kleiber |
| 2013/0213331 | A1 | 8/2013 | Landersdorfer et al. |

FOREIGN PATENT DOCUMENTS

| | | | |
|---|---|---|---|
| DE | 10161701 | | 6/2003 |
| DE | 10 2006 039371 | | 2/2008 |
| DE | 102009038662 | A1 | 4/2011 |
| DE | 10 2010 046619 | | 3/2012 |
| EP | 2 527 607 | | 11/2012 |
| GB | 2 444 943 | | 6/2008 |

* cited by examiner

CAMSHAFT ADJUSTER

The present invention relates to a camshaft adjuster.

Camshaft adjusters are generally used in valve train assemblies of internal combustion engines to vary the valve opening and closing times, whereby the consumption values of the internal combustion engine and the operating behavior in general may be improved.

BACKGROUND

One specific embodiment of the camshaft adjuster, which has been proven and tested in practice, includes a vane adjuster having a stator and a rotor, which delimit an annular space, which is divided into multiple working chambers by projections and vanes. A pressure medium may be optionally applied to the working chambers, which is supplied to the working chambers on one side of the vanes of the rotor from a pressure medium reservoir in a pressure medium circuit via a pressure medium pump, and which is fed back into the pressure medium reservoir from the working chambers on the particular other side of the vanes. The control of the pressure medium flow, and thus the adjusting movement of the camshaft adjusting device, takes place, e.g., with the aid of a central valve having a complex structure of flow-through openings and control edges, and a valve body, which is movable within the central valve and which closes or unblocks the flow-through openings as a function of its position.

SUMMARY OF THE INVENTION

The central valve is guided together with a central screw through a central opening in the rotor and screwed in the camshaft, so that the rotor is subsequently clamped together with the camshaft to form a rotatably fixed assembly. Since the position of the rotor with respect to the camshaft is extremely important for the function of the camshaft adjuster, and the position should preferably no longer be changed after clamping, the central screw must be screwed in the camshaft with a correspondingly high pretensioning force to establish a preferably rotatably fixed clamped assembly, whereby, in turn, comparatively high component stresses occur in the central screw, in the rotor and in the camshaft. These component stresses should not exceed maximum material characteristics, so that limits are imposed on the dimensioning of the components. The comparatively high component stresses may furthermore also result in a shortening of the service life of the components.

It is an object of the present invention to provide a camshaft adjuster having a lower component stress.

The present invention provides that at least one of the clamping surfaces of the rotor and/or the camshaft is profiled, at least in sections, to establish a form-locked connection. Due to the profiling and the form-locked connection between the rotor and the camshaft established thereby, the circumferential forces are now transmitted via a form-locked connection and not, as before, with the aid of a pure surface pressing, so that, to establish the rotatably fixed assembly, the central screw must be clamped with the aid of a lower pretension applied via the central screw and a lower component stress of the camshaft, the rotor and central screw induced thereby for the purpose of transmitting a predetermined circumferential force. Ideally, the circumferential forces are then transmitted solely with the aid of the form-locked connection, while the pretensioning force is used only to hold the components together. Moreover, the rotor is thereby better secured against unintentional twisting with respect to the camshaft. Within the meaning of the present invention, the term "profiling" is understood to be any surface structure deliberately created by machining the component or with the aid of a certain type of manufacturing of the component, which is suitable, when clamping the components, to establish a form-locked connection of the components in the circumferential direction, i.e., transversely to the clamping direction, with the aid of an engagement with the opposite clamping surface.

It is furthermore proposed that one of the clamping surfaces of the rotor or the camshaft is profiled, and the opposite clamping surface on the particular other part is not profiled, and the surface hardness of the profiled clamping surface is greater than the surface hardness of the unprofiled clamping surface. The profiled surface of the one part is deliberately pushed into the surface of the unprofiled part during the clamping of the component, due to the greater surface hardness, so that a form-locked connection of the two components is subsequently established. The machining effort may be reduced solely by profiling one of the surfaces. The different surface hardness may be achieved either by selecting different materials or with the aid of a corresponding surface treatment, it being possible to additionally use the manufacturing of the profiled surface to increase the hardness.

A particularly good form-locked connection may be provided thereby, in that the oppositely situated clamping surfaces of the rotor and the camshaft are profiled, and one of the clamping surfaces is the negative replica of the particular other clamping surface. Due to the proposed design of the clamping surfaces, a preferably large contact surface of the two components may be achieved, including a simultaneously greatest possible form-locked overlap of the clamping surfaces in the circumferential direction. The negative replica may be formed, e.g., with the aid of two toothings of the same toothing geometry, which are oriented with respect to each other in such a way that the teeth of the one toothing engage with the toothing bases of the particular other toothing.

It is furthermore proposed that the profiled clamping surface is formed by a regular arrangement of indentations and elevations. Due to the regular arrangement of indentations and elevations, in particular of an essentially identical height or depth, at least in groups, a uniform load per surface unit and a uniform transmission of the circumferential forces may be achieved, so that the clamping surfaces may be preferably uniformly loaded, and the maximum component stresses in the clamping surfaces are preferably low.

According to one refinement, it is proposed that a profiled clamping surface having indentations and elevations is provided both on the rotor and on the camshaft, and the indentations and elevations are oriented and situated in such a way that they cross each other when the clamping surfaces come into contact with each other. Due to the crossing indentations and elevations, the components may be additionally connected to each other thereby, in that the elevations of the clamping surface of one of the components dig into the elevations of the clamping surface of the particular other component. Very high stresses are deliberately generated in the crossing points of the elevations during the tightening of the central screw, due to the punctiform loads, so that the digging in of the elevations may be induced even with lower pretensioning forces applied via the central screw.

A particularly large form-locked overlap of the two surfaces, which is effective for transmitting the circumferential forces, may be achieved if the indentations and elevations of the profiled clamping surface of the rotor or the camshaft extend in the radial direction, and the indentations and elevations of the opposite clamping surface extend in the circumferential direction. Moreover, the components may thereby be connected to each other in a form locked manner not only in the circumferential direction but also in the radial direction, in that the elevations of both clamping surfaces penetrate the elevations of the opposite clamping surfaces.

It is furthermore proposed that the indentations and/or the elevations are structured with the aid of at least one group of shoulders or webs of the same height or depth with a lesser depth than the indentations and/or a lesser height than the elevations. Due to the proposed shoulders or webs and the intermediate plane created thereby in the surface of the clamping surface, additional form-locked contact surfaces are created, via which the components may be additionally connected to each other in a form-locked manner in the running direction of the elevations or indentations.

In this case, the form-locked assembly of the two components may be provided with a particularly uniform design if the indentations and the elevations and the shoulders or webs are situated in such a way that the indentations or elevations form a uniform lattice structure together with the imaginary connecting lines of the shoulders or webs of the adjacent indentations.

The manufacture of the profiled clamping surface is particularly easy if the indentations and elevations are linear. In addition, a further uniform loading of the components in the clamping surface may be achieved thereby.

In particular, the indentations and elevations of the camshaft may be manufactured by a machining process, and those of the rotor may be manufactured with the aid of a sintering process. Since the rotor is a complex spatial component having a large number of functionally relevant surfaces aligned in different orientations and arrangements with respect to each other, a manufacture of the rotor along with the profiled clamping surface in a sintering process suggests itself, since more complex surfaces may be very easily manufactured with the aid of sintering. The camshaft, on the other hand, may be more easily machined, due to its shape, since the camshaft may be very easily clamped and processed for the machining operation. Due to the machining process, a clamping surface having a very high dimensional accuracy of the surface may be implemented, in particular with respect to the rotation axis of the camshaft and thus also indirectly with respect to the rotation axis of the rotor.

BRIEF DESCRIPTION OF THE DRAWINGS

The present invention is explained in greater detail below on the basis of multiple preferred exemplary embodiments. Specifically.

DETAILED DESCRIPTION

Figure 1:
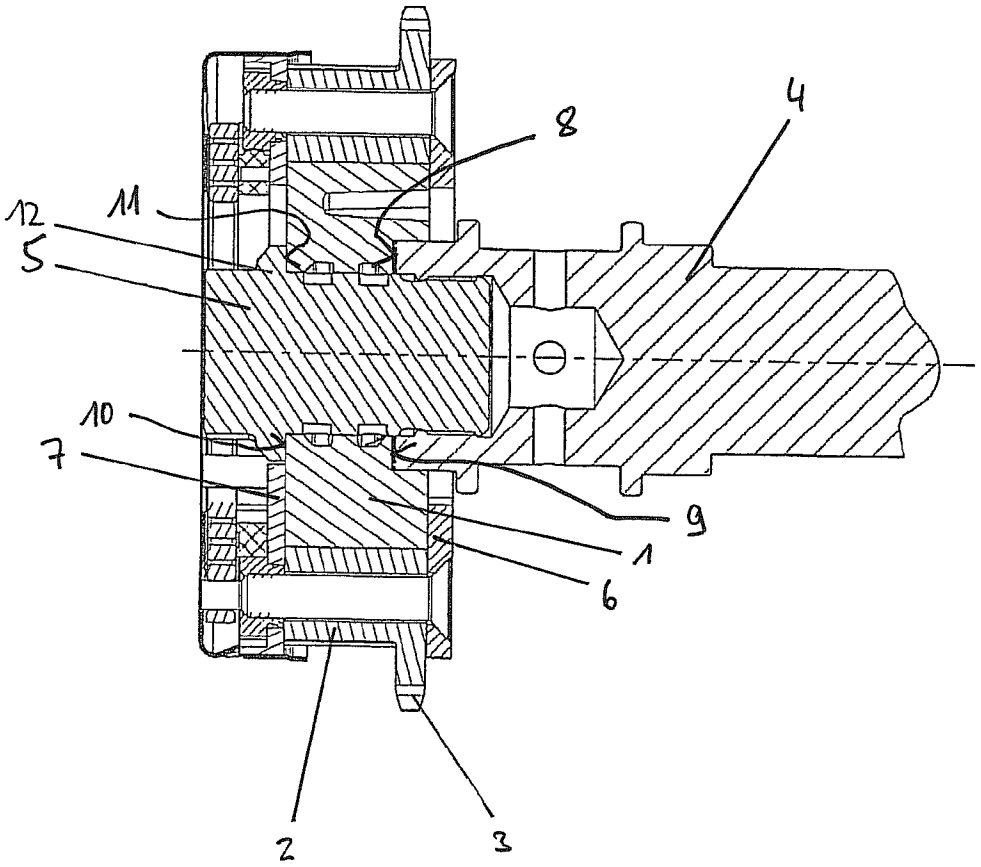
FIG. 1: shows a sectional representation of a camshaft adjusting device.

A camshaft adjuster of an internal combustion engine according to the present invention, including a stator 2 and a rotor 1, is apparent in FIG. 1. Stator 2 is provided with a toothing 3 on its outside for the purpose of being driven by a crankshaft via a chain or toothed belt. Rotor 1 is connected to camshaft 4 in the known manner with the aid of a central screw 5 and is driven to a rotary motion via stator 2. Stator 2 furthermore includes a plurality of stator webs, which divide an annular space provided between stator 2 and rotor 1 into multiple pressure chambers 12. Rotor 1 includes a plurality of vanes, which extend radially outwardly to the inner wall of stator 2 and divide each pressure chamber into two working chambers. Two sealing covers 6 and 7 are furthermore provided, which laterally seal the working chambers. During operation of the internal combustion engine, the pressure chambers are filled with pressure medium at least after a certain start phase of the internal combustion engine, whereby the rotary motion of stator 2 is transmitted to rotor 1 and finally to camshaft 4.

Rotor 1 is clamped to camshaft 4 with the aid of a central screw 5, rotor 1 being clamped between a head 12 of central screw 5 and the front side of camshaft 4. Central screw 5 is screwed into a thread of camshaft 4 and clamps rotor 1 to camshaft 4 via oppositely situated clamping surfaces 10 and 11 and 9 and 8 to form a rotatably fixed assembly.

Since the assembly of rotor 1 and camshaft 4 is held together solely by the clamping force of central screw 5, and the assembly must be correspondingly fixedly clamped for the purpose of transmitting the rotary motion, comparatively high component stresses arise in central screw 5, rotor 1 and camshaft 4, in particular in the area of clamping surfaces 8, 9, 10 and 11.

Figure 2:
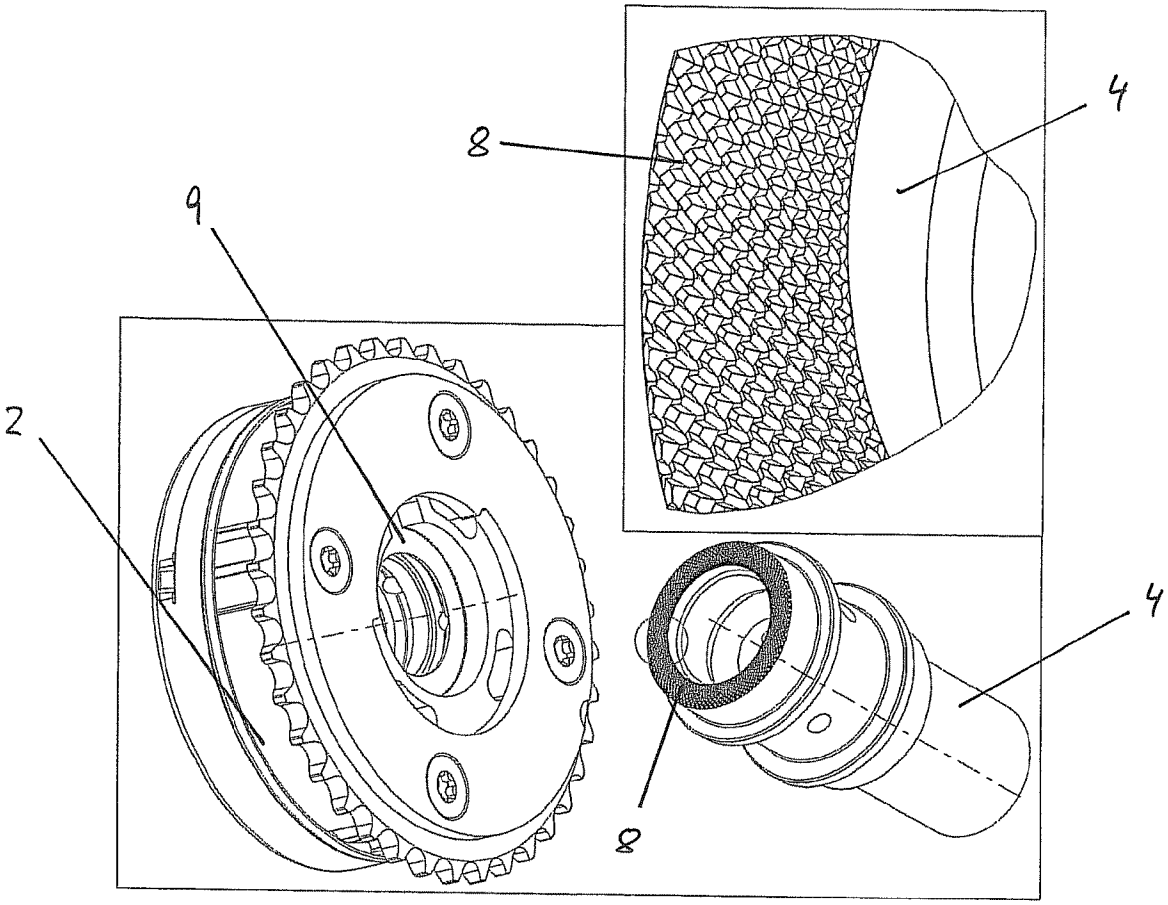
FIGS. 2 through 7: show different camshaft adjusting devices having differently profiled clamping surfaces on the rotor and on the camshaft.

To reduce these component stresses, clamping surface 8 in the exemplary embodiment illustrated in FIG. 2 is designed to be profiled with a regular arrangement of pointed elevations and indentations. A profiled surface of this type may be manufactured by knurling. Oppositely situated clamping surface 9 of rotor 1 is not profiled, i.e., it has a smooth design apart from a manufacturing-induced surface roughness in the magnitude of just a few micrometers. When clamping rotor 1 with the aid of central screw 5, profiled clamping surface 8 having the pointed elevations is pushed into unprofiled clamping surface 9, so that a form-locked connection is subsequently implemented between rotor 1 and camshaft 4 in the circumferential direction, due to the elevations. The penetration of pointed elevations of clamping surface 8 into clamping surface 9 may be facilitated in that clamping surface 8 has a greater surface hardness than clamping surface 9, at least in the area of the profiling.

Figure 3:
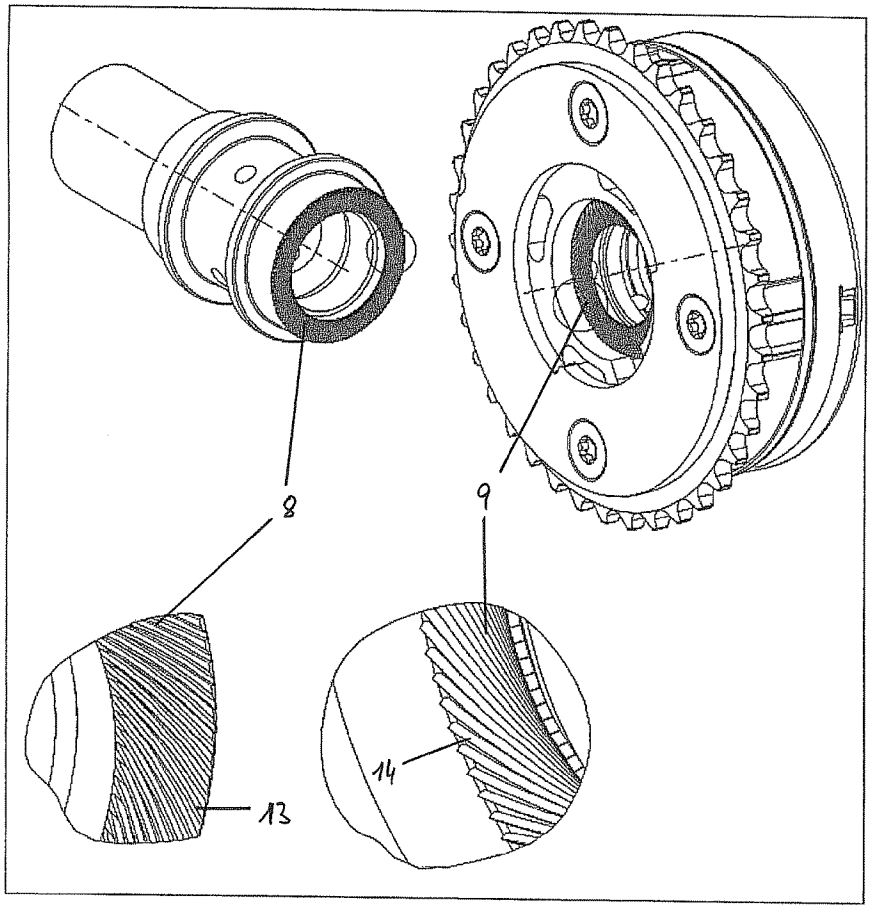

An alternative specific embodiment of the present invention is apparent in FIG. 3, in which both clamping surfaces 8 and 9 are profiled. The profiling of clamping surfaces 8 and 9 here is implemented by spiral, linear elevations 13 and 14, which are oriented in different directions and thereby cross each other when they make contact with each other during the clamping of rotor 1 to camshaft 4. Due to the crossing of elevations 13 and 14, the latter engage with each other in clamping surfaces 8 and 9 at the crossing points and thereby form a form-locked connection of clamping surfaces 8 and 9 in both the circumferential and the radial directions. Since clamping surfaces 8 and 9 are subjected to a very high load per surface unit at the crossing points of elevations 13 and 14, the process of mutual penetration of clamping surfaces 8 and 9 is supported, in this case an identical or similar surface hardness of the two clamping surfaces 8 and 9 being favorable for elevations to penetrate each other.

Figure 4:
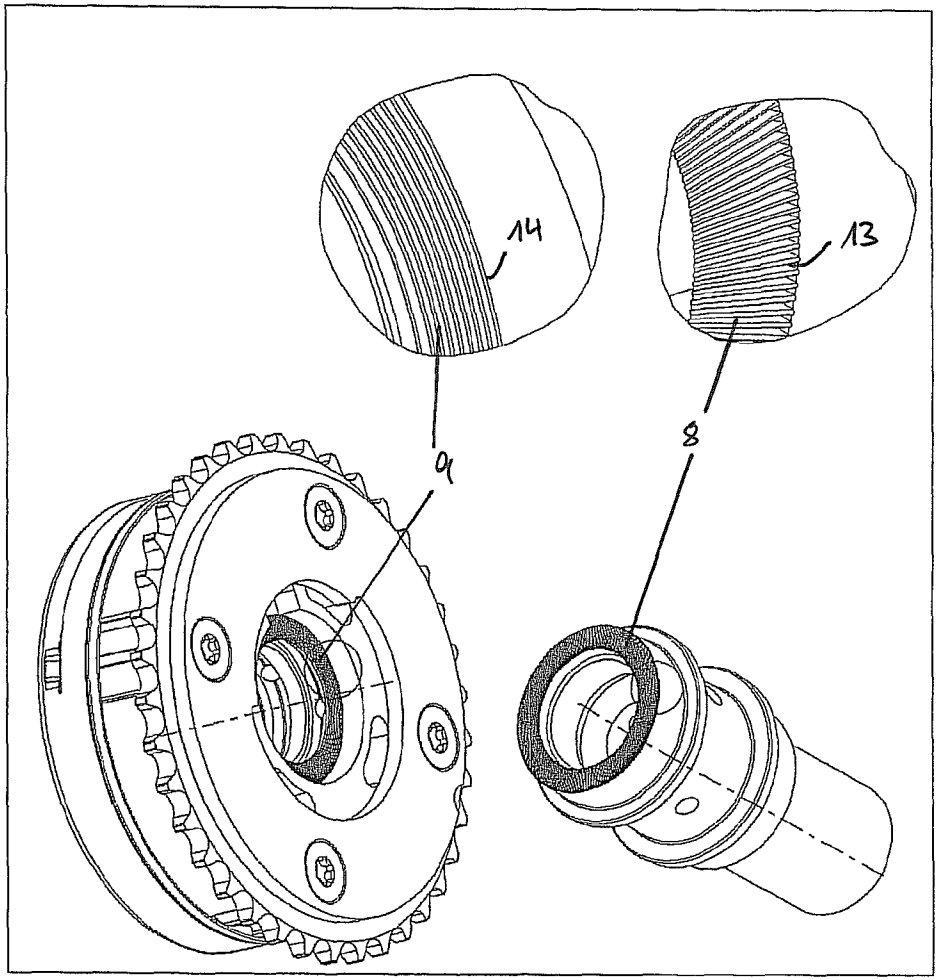

In the exemplary embodiment illustrated in FIG. 4, the same effect is achieved by a profiling of clamping surfaces 8 and 9 with radially oriented, linear elevations 13 in front clamping surface 8 of camshaft 4 and annular elevations 14 in front clamping surface 9 of rotor 1.

Figure 5:
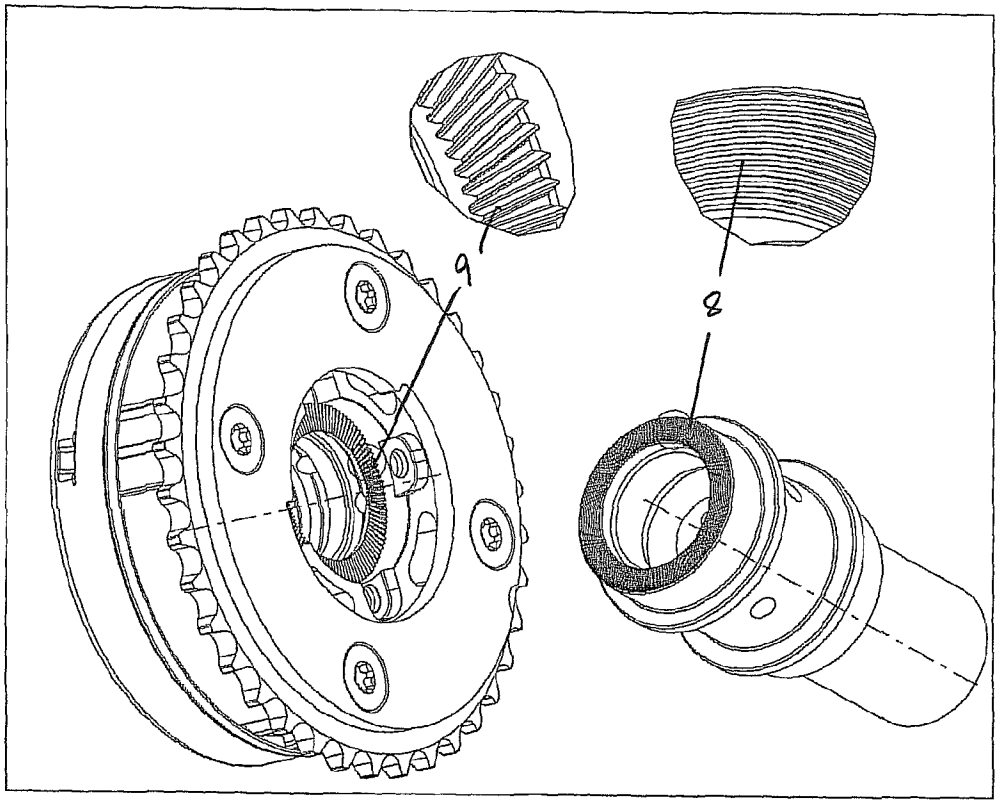

Another alternative specific embodiment is apparent in FIG. 5, in which the orientation of elevations 13 and 14 is designed in reverse compared to the exemplary embodiment illustrated in FIG. 4.

Figure 6:
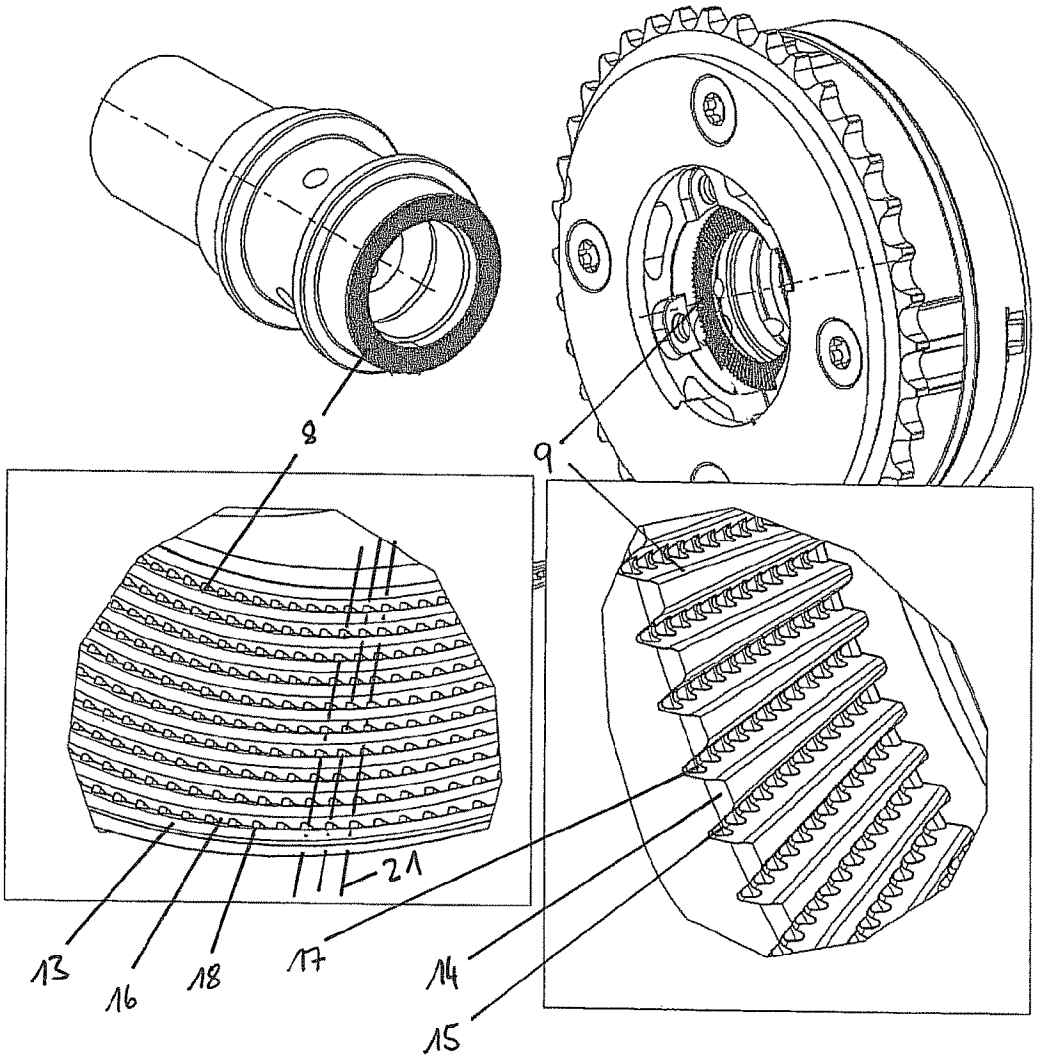

In the exemplary embodiment in FIG. 6, elevations 13 on clamping surface 8 have an annular shape, and elevations 14 on clamping surface 9 are radially oriented. Webs 17 and 18 are provided at regular intervals in indentations 15 and 16 between elevations 13 and 14. The distances between webs 17 and 18 in indentations 15 and 16 are identical in groups, so that imaginary connecting lines 21 of webs 17 and 18 of one of clamping surfaces 8 or 9, together with elevations 13 or 14 of a clamping surface 8 or 9, span an imaginary lattice. Additional contact surfaces situated transversely to elevations 13 and 14 are created by webs 17 and 18, whereby the form-locked overlap of the two clamping surfaces 8 and 9 may be further enlarged.

For the form-locked assembly of rotor 1 and camshaft 4, it is sensible overall if clamping surfaces 8 and 9 overlap by a preferably large area in a form-locked manner, particularly in the circumferential direction, so that the relative position of camshaft 4 in the rotation direction with respect to rotor 1 is preferably not changed even during the operation of the internal combustion engine. This may be achieved, e.g., by a deliberately selected large difference in the surface hardnesses of clamping surfaces 8 and 9, in that elevations 13 or 14 deliberately preferably penetrate opposite clamping surface 8 or 9. Alternatively, however, clamping surfaces 8 and 9 may also deliberately have an identical or similar surface hardness, so that elevations 13 and 14 penetrate particular opposite clamping surface 8 or 9 on both sides during clamping, so that a preferably complex and non-directional form-locked fit of clamping surfaces 8 and 9 is subsequently implemented.

Figure 7:
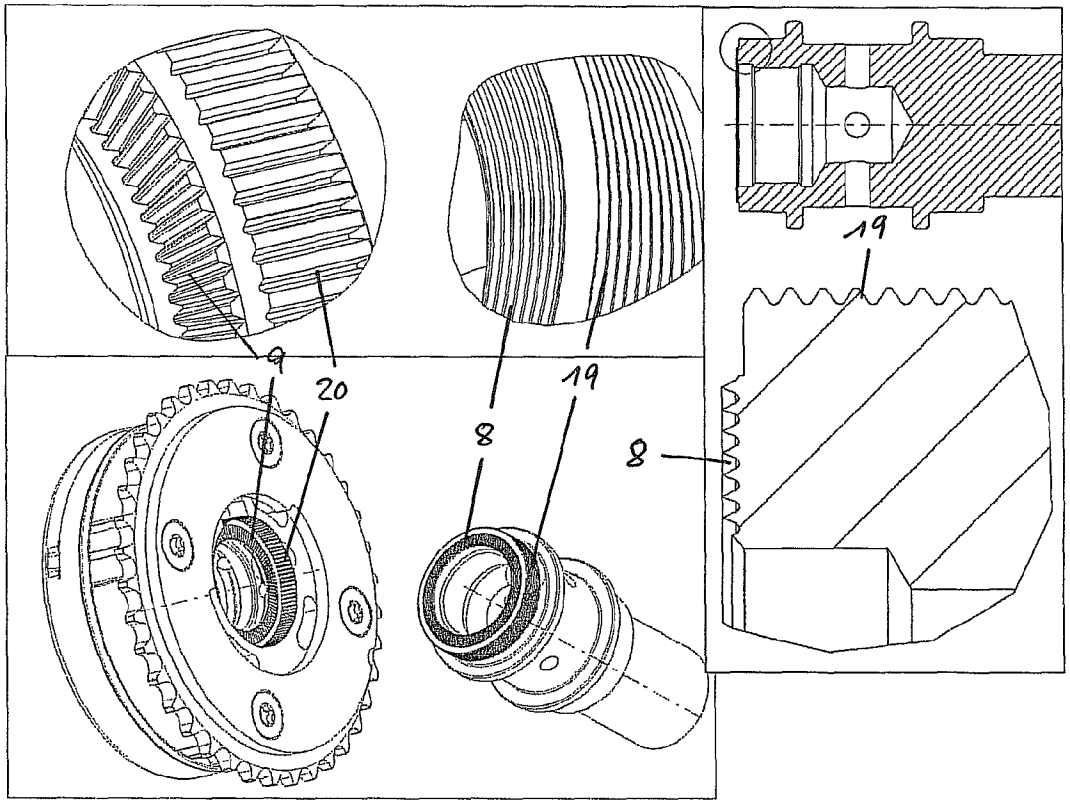

Another specific embodiment of the present invention is apparent in FIG. 7, in which, in addition to front clamping surfaces 8 and 9 on camshaft 4 and rotor 1, clamping surfaces 19 and 20 are also provided with a profiling on the outer circumference or on an inner circumferential surface. Clamping surfaces 19 and 20 may be provided with identical angles in a conical manner and a corresponding shape, so that they are brought together during the assembly of camshaft 4 and rotor 1, with a continuous reduction in the surface distance between clamping surfaces 19 and 20.

In all exemplary embodiments described, oppositely situated clamping surfaces 8 and/or 9 on rotor 1 and camshaft 4 are profiled, while oppositely situated clamping surfaces 10 and 11 on central screw 5 and/or rotor 1 are deliberately not profiled. Since central screw 5 must carry out a rotary motion with respect to camshaft 4 during the clamping of rotor 1, and the relative angle position between rotor 1 and camshaft 4 should preferably remain constant at least after clamping, the movement behavior of the components to be clamped may be set during clamping by the "non-profiling" of clamping surfaces 10 and 11 and the deliberate profiling of clamping surfaces 8 and/or 9 in such a way that central screw 5 rotates with respect to rotor 1, and rotor 1 is simultaneously at least almost rotatably fixedly fixed with respect to camshaft 4. During clamping, rotor 1 may be supported on camshaft 4 with the aid of the form-locked connection, and it carries out a purely axial movement, during which profiled clamping surfaces 8 and 9 penetrate each other and come into contact with each other with increasing form-locked overlap.

LIST OF REFERENCE NUMERALS

1 rotor
2 stator
3 toothing
4 camshaft
5 central screw
6 sealing cover
7 sealing cover
8 clamping surface
9 clamping surface
10 clamping surface
11 clamping surface
12 head
13 elevation
14 elevation
15 indentation
16 indentation
17 webs
18 webs
19 clamping surface
20 clamping surface
21 connecting lines

What is claimed is:

1. A camshaft adjusting device comprising:

a vane adjuster including a stator connectable to a crankshaft of an internal combustion engine, and a rotor rotatably supported in the stator and connectable to a camshaft, the vane adjuster having a plurality of working chambers provided between the stator and the rotor, a pressure medium capable of being applied to the plurality of working chambers; and a central screw for clamping the rotor to the camshaft via oppositely situated clamping surfaces of the rotor and the camshaft, at least one of the clamping surfaces of the rotor or the camshaft being profiled, at least in sections, forming a profiled surface, the profiled surface including repeating indentations and elevations configured for establishing a form-locked connection rotationally fixing the rotor to the camshaft.

2. The camshaft adjusting device as recited in claim 1 wherein one clamping surface of the clamping surfaces of the rotor and the camshaft is profiled and the opposite clamping surface of the clamping surfaces on the other of the rotor and the camshaft is not profiled; and a surface hardness of the profiled one clamping surface is greater than the surface hardness of the unprofiled opposite clamping surface.

3. The camshaft adjusting device as recited in claim 1 wherein the oppositely situated clamping surfaces of the rotor and the camshaft are profiled; and one of the clamping surfaces is the negative replica of the other clamping surface.

4. The camshaft adjusting device as recited in claim 1 wherein the profiled clamping surface is formed by a regular arrangement of indentations and elevations.

5. The camshaft adjusting device as recited in claim 4 wherein a profiled clamping surface having indentations and elevations is provided both on the rotor and on the camshaft, and the indentations and elevations on the clamping surfaces are oriented and situated in such a way that they cross each other when the clamping surfaces come into contact with each other.

6. The camshaft adjusting device as recited in claim 5 wherein the indentations and elevations of one of the profiled clamping surfaces of the rotor or the camshaft extend in the radial direction, and the indentations and elevations of the particular opposite clamping surface extend in the circumferential direction.

7. The camshaft adjusting device as recited in claim 4 wherein the indentations or elevations are structured with the aid of at least one group of shoulders or webs with a lesser depth than the indentations or a lesser height than the elevations.

8. The camshaft adjusting device as recited in claim 7 wherein the indentations and the elevations and the shoulders or webs are situated in such a way that the indentations or elevations form a uniform lattice structure together with the imaginary connecting lines of the shoulders or webs of the adjacent indentations or elevations.

9. The camshaft adjusting device as recited in claim 4 wherein the indentations and elevations are linear.

10. The camshaft adjusting device as recited in claim 1 wherein the camshaft includes the profiled clamping surface in the form of indentations and elevations manufactured by a machining process, and the rotor includes the profiled clamping surface in the form of indentations and elevations manufactured in a sintering process.

11. A camshaft adjusting device comprising:

a vane adjuster including a stator connectable to a crankshaft of an internal combustion engine, and a rotor rotatably supported in the stator and connectable to a camshaft, the vane adjuster having a plurality of working chambers provided between the stator and the rotor, a pressure medium capable of being applied to the plurality of working chambers; and a central screw for clamping the rotor to the camshaft, the rotor including an outer circumferential surface, an inner circumferential surface and a first radially extending clamping surface, the camshaft including an outer circumferential surface, an inner circumferential surface and a second radially extending clamping surface, the first and second radially extending clamping surfaces engaging each other, one of the first or second radially extending clamping surfaces being profiled between the respective outer circumferential surface and inner circumferential surface, at least in sections, to include repeating indentations and elevations configured for engaging with the other of the first or second radially extending clamping surfaces so as to establish a form-locked connection rotationally fixing the rotor to the camshaft.

12. The camshaft adjusting device as recited in claim 11 wherein the other of the first or second radially extending clamping surfaces is also profiled to include repeating indentations and elevations.

* * * * *